US005419057A

United States Patent [19]

Jackson

[11] Patent Number: 5,419,057

[45] Date of Patent: May 30, 1995

[54] FLOOR JOIST SQUARE

[76] Inventor: William J. Jackson, Rte. 1, Box 38E, Colbert, Ga. 30628

[21] Appl. No.: 982,838

[22] Filed: Nov. 30, 1992

[51] Int. Cl.[6] ..... B43L 7/027; B43L 13/20

[52] U.S. Cl. ..... 33/562; 33/411

[58] Field of Search ..... 33/562, 411, 563, 403, 33/429, 474

[56] References Cited

U.S. PATENT DOCUMENTS

| | | | |
|---|---|---|---|
| 1,143,426 | 6/1915 | Miller | 33/411 |
| 3,010,209 | 11/1961 | McKinley | 33/562 |
| 3,104,467 | 9/1963 | Lloyd-Young | 33/562 |
| 3,529,361 | 9/1970 | Parsons, Jr. | 33/562 |
| 4,361,964 | 12/1982 | Hennessee | 33/563 |
| 4,928,399 | 5/1990 | Kragt | 33/562 |

*Primary Examiner*—Christopher W. Fulton
*Attorney, Agent, or Firm*—Hopkins & Thomas

[57] ABSTRACT

A template square (10) for marking a length of floor joist lumber to be cut into a floor joist board for mounting to a support beam in the center sill support framework of a building. The template plate (10) comprises notches (26,27), slots (31), flange pieces (14,15), and tension springs (16, 17). The flange pieces (14,15) mount within the slots (31) to form a flange along the upper portion of the template square (10) so that the template square can be aligned on the floor joist lumber with the flange abutting the top edge of the lumber. So arranged, a cut-line can be traced along a side edge (22,23) of the template square (10) with the notch (26,27) spaced a predetermined distance from the flange.

3 Claims, 2 Drawing Sheets

FLOOR JOIST SQUARE

FIELD OF THE INVENTION

This invention pertains to a device for marking floor joist lumber that is to be cut into floor joist boards and used in the construction of the center sill support frame work of a building or house. More particularly, this invention pertains to a device for tracing a notched cut-line at intervals along the length of floor joist lumber so that the floor joist board can be cut with a notched segment in the lower corners of the floor joist board, which notches allow the floor joist board to mount to a support beam having a bond timber running along its lower edge.

BACKGROUND OF THE INVENTION

In the construction of residential homes and small commercial buildings, as well as other similar structures, the center sill support framework for the building typically comprises a perimeter sill secured around the foundation of the building and one or more center beams extending transversely across the foundation between the perimeter sill boards. The perimeter sill and the center beams are constructed with a support ledge or a bond timber running along their lower edges, which forms a shoulder for supporting the notched ends of the floor joists. The floor joists are mounted parallel to each other and extend transversely between the perimeter sill and the center beam to form an array of floor joist boards, which together with the center beam and the perimeter sill form the center sill support framework for the building.

The ends of the floor joist boards have a notched portion for mating with the bond timber of the support beam, either the center beam or the perimeter sill, in a manner so that the top longitudinal edge of the floor joist boards and the top longitudinal edges of the support beam are substantially in a common plane to provide a level surface for fastening the plywood and subflooring of the building. The cross-sectional dimensions of the bond timber are dictated by the structural loads of the building that the center beam or perimeter sill must support. For example, some building codes require a 2×2 inch bond timber when using a 2×8 inch floor joist, and a 2×4 inch bond timber when using a 2×10 inch or 2×12 inch floor joist. While the terms 2×2, 2×4, 2×8, 2×10, and 2×12 are referred to throughout the specification in terms of inches, it will be understood by those skilled in the art that the actual dimensions for the referenced boards are somewhat less, as is commonly understood in the construction industry.

A typical method for cutting floor joist boards utilizes a pattern board, which a carpenter cuts from a length floor joist lumber to the length of the floor joist boards required for a particular application. The carpenter then cuts notches in the lower corners of the floor joist pattern board with the dimensions of the notches being equivalent to the dimensions of the bond timber, as dictated by the height requirement of the floor joist boards. With the pattern board properly cut, usually two carpenters place the pattern board over an uncut length of floor joist lumber, and each carpenter traces with a marker along an end of the floor joist pattern board. The carpenters then remove the floor joist pattern board and each carpenter saws his end of the floor joist lumber and cuts out the marked notched portions to produce a floor joist board. The carpenters then place the floor joist pattern board on top of the next segment of the floor joist lumber and repeat the process.

A problem with this method for cutting floor joist boards is that it generally requires two carpenters to perform the cutting process in an efficient manner. One carpenter marks and saws one end of the floor joist board while the other carpenter marks and saws the other end of the floor joist board, and then together the two carpenters move the floor joist pattern board onto the next segment of the floor joist lumber. Such an operation is labor intensive.

Another problem with this method for marking the floor joist lumber is that the dimensions of the notched portion are measured from the lower edge of the floor joist board rather than from the top edge. As a result, any variances in the lumber appear along the top longitudinal edge of the floor joist board when mounted to a support beam and, thus, an unlevel surface can be created between the top edges of the floor joists and the top edges of the perimeter sill and center beams. Ideally, the top edges of the center sill support framework, that is the top edges of the floor joists, perimeter sill, and center beams, lie substantially in a common plane so that a level structural support framework is created to which the plywood and the subflooring can be attached.

Another problem with this method for cutting floor joist boards is that a different floor joist pattern board needs to be cut when the height dimension of the floor joist boards changes.

Accordingly, a heretofore unaddressed need exists for an apparatus for use by carpenters in marking and cutting floor joist boards that can be used by a single carpenter to mark and cut accurately and quickly the notches from the corners of the floor joist boards of varying dimension.

SUMMARY OF THE INVENTION

Briefly described, the present invention, in a preferred embodiment thereof, is a template plate for tracing a cut-line along a floor joist board so that a carpenter can cut the board therealong to produce a cut side edge at the end of the floor joist board of such dimensions as to mate with a support beam transverse to the floor joist board. The template plate is generally a square plate having a pair of side edges, a top edge, and a bottom edge. A pair of notches along the bottom and side edges are formed in the lower corners of the floor joist square with each notch corresponding to a common bond timber dimension of an associated structural support beam of the center sill support framework for a building such as a residential home. In a preferred embodiment, one notch has dimensions corresponding to a 2×2 inch bond timber and the other notch has dimensions corresponding to a 2×4 inch bond timber.

In the upper portion of the floor joist square are a plurality of spaced pairs of slots aligned parallel with the top edge of the floor joist square. Each pair of slots comprises a slot on each side edge of the template plate. The pairs of slots are spaced from the upper edges of the notches at the lower corners of the floor joist square a distance equivalent to the common heights for center beams less the height of the bond timber for the center beams. The common heights of the center beams are typically either 8, 10, or 12 inches in height and require either a 2×2 inch bond timber or a 2×4 inch bond timber along the lower edge thereof for mating with the notches in the floor joist boards.

A pair of flange brackets are provided that each slide into and out of one of the pairs of slots that are on the floor joist square's side edge. Together the pair of flange brackets form a composite flange below the top edge of the floor joist square. The composite flange allows the floor joist square to mount along the top longitudinal edge of the floor joist lumber to be cut. The composite flange aligns the side edges of the floor joist square and the notches therein with respect to the top longitudinal edge of the floor joist lumber such that a cut line can be traced along the notches and edges of the floor joist square.

In a preferred embodiment, three pairs of slots are provided in the upper portion of the floor joist square, each slot pair having a slot to one side of the floor joist square. Preferably, the upper pair of slots is spaced 12 inches from the bottom edge of the floor joist square; the middle pair of slots is spaced 10 inches from the bottom edge; and the lower pair of slots is spaced 8 inches from the bottom edge. Typically the 2×2 inch notch of the template plate is utilized in conjunction with the slots spaced 8 inches from the bottom edge of the template square, and the 2×4 inch notch is utilized in conjunction with the slots spaced 10 and 12 inches from the bottom edge.

The flange brackets are designed to slide into their corresponding slots to create a composite flange adjacent the top edge of the template, such that the flange brackets project forwardly and rearwardly of the template plate to create a composite flange along the front side and the back side of the floor joist square. With a composite flange created at the front and back of the floor joist square, the floor joist square can be used to mark a cut-line at one end of the length of floor joist lumber with the back flange against the top edge of the floor joist lumber. The floor joist square can then be flipped over and moved to the other end of the floor joist lumber where the floor joist board is to be cut and used to mark a cut-line along the same edge of the floor joist square with the front flange against the top edge of the floor joist lumber. With such an arrangement, a single carpenter can use the floor joist square of the present invention to mark and cut both ends of the floor joist lumber from which the floor joist board is to be cut in a simple, quick, and efficient manner.

In addition, the floor joist square of the present invention properly spaces the notches along its lower corners from the top edge of the floor joist board. The flange brackets provide an adjustable mechanism for properly spacing the notches from the top edge of the floor joist board so that any variances in the height of the lumber appear along the lower edge of the floor joist board once installed and mounted to the center beams or perimeter sill of the center sill framework.

In order to mark and cut a floor joist board of a different height, a carpenter can easily remove the flange brackets from their slots and reinsert them into the corresponding pair of slots for the desired height of the floor joist board. Thus, the carpenter does not have to cut a separate floor joist pattern board in order to mark and cut floor joist boards having a different height dimension.

Accordingly, it is an object of the present invention to allow a single carpenter to mark and cut floor joist boards from a length of floor joist lumber in a simple, quick, and efficient manner.

Another object of the present invention is to provide a means for accurately positioning the notches in the lower corner of the floor joist boards so that any variances in the height of the floor joist lumber appear along the lower edge of the floor joist boards once the floor joist board is mounted to a support beam.

Another object of the present invention is to provide a floor joist marking device that can be easily adapted to mark and cut floor joist boards of different heights.

Another object of the present invention is to provide a floor joist marking device that is handy to use and durable in structure to withstand the rugged conditions of the construction industry.

These and other objects, features and advantages of the present invention will become apparent from the following specification, when read in conjunction with the accompanying drawings.

DETAILED DESCRIPTION

Figures 1, 2, 3:
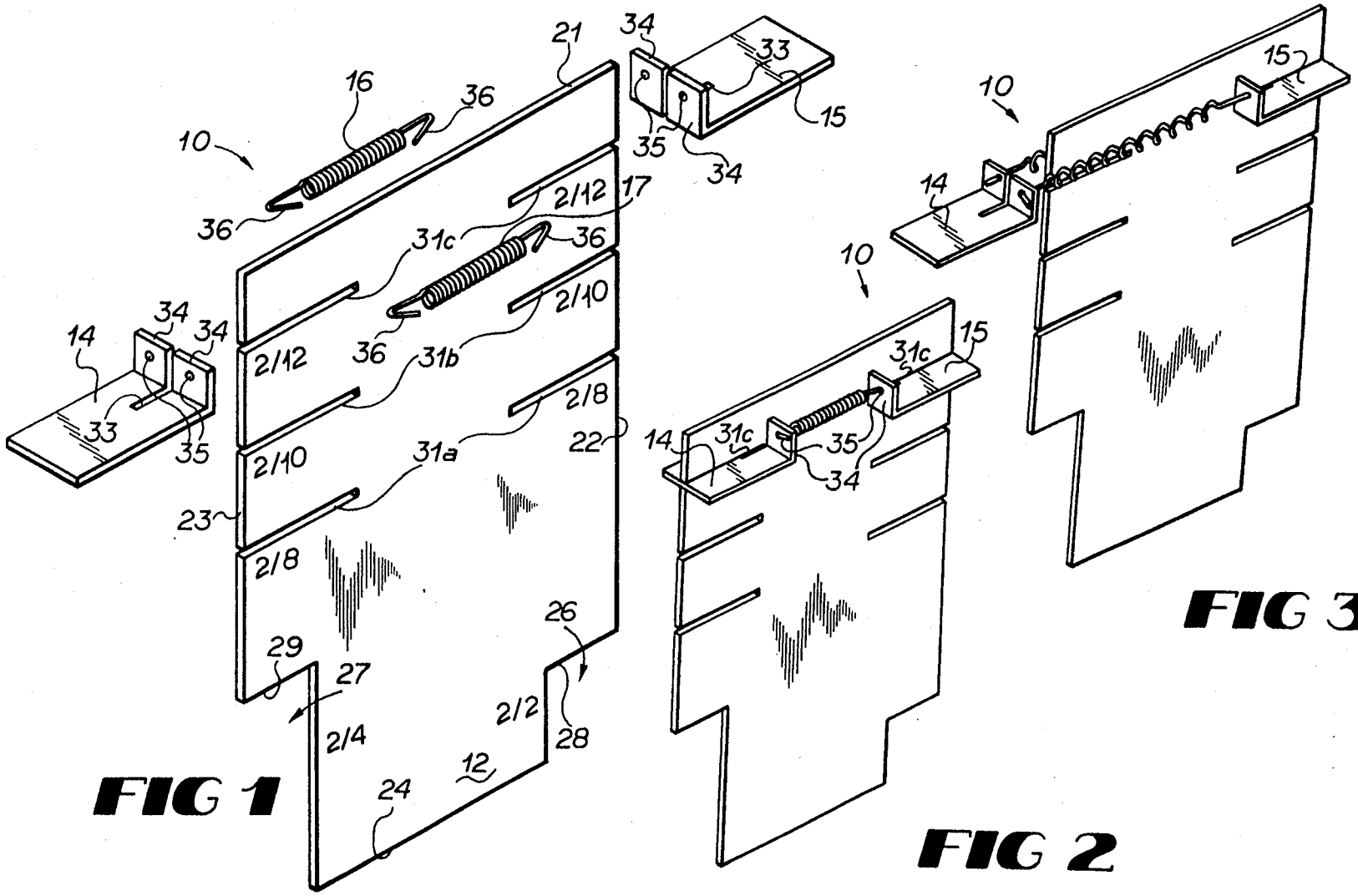
FIG. 1 is an enlarged exploded perspective view of the floor joist square of the present invention.
FIG. 2 is a perspective view of the floor joist square of FIG. 1.
FIG. 3 is a perspective view of the floor joist square of FIG. 2 illustrating one of the flange brackets removed from its slot.

Referring now in more detail to the drawings, in which like numerals represent like parts throughout the several views, FIG. 1 illustrates an enlarged exploded view of the floor joist square 10 constructed in accordance with a preferred embodiment of the present invention. The floor joist square 10 comprises a template plate 12, a pair of flange brackets 14 and 15, and a pair of tension springs 16 and 17. The template plate 12 is generally square and has a top edge 21, two side edges 22,23, and a bottom edge 24. A pair of notches 26,27 are cut in the lower corners of the template plate 12. The dimensions of notch 26 correspond to a 2×2 inch bond timber and the dimensions of notch 27 correspond to a 2×4 inch bond timber. The notches 26, 27 each have a first segment 28, 29 respectively, that extends parallel to the top edge 21 of the plate 12.

The upper portion of the template plate 12 includes a plurality of pairs of slots 31*a*, 31*b*, and 31*c* along the side edges thereof that extend inwardly from the side edges 22,23 of the template plate 12 and parallel to the top edge 21. The pairs of slots 31 are labeled according to the cross-sectional dimensions of the floor joist board (and the center beam and perimeter sill) to be marked and cut with the floor joist square. The bottom edge 24 of the template plate 12 is the point from which the set of slots 31 are measured. For example, the distance between slots 31*a* and the bottom edge 24 corresponds to an 8 inch board, as measured perpendicularly to the slots, the distance between slots 31*b* and the bottom edge 24 corresponds to a 10 inch board, and the distance between slots 31*c* and the bottom edge 24 corresponds to a 12 inch board. Slots 31*a* and notch 26 are used when marking a floor joist board that is 8 inches in height. Slots 31*b*, and 31*c*, and notch 27 are used when marking a floor joist board that is 10 or 12 inches in height, respectively.

So arranged, the distances between the upper edges or segments 28,29 of notches 26,27 are spaced a predetermined distance from the pairs of slots 31 so that the segment of the cut-line corresponding to edges 28,29 is spaced a predetermined distance from the top edge of the floor joist lumber. Each flange bracket 14,15 is generally rectangular in shape and includes a slot 33 extending from one end thereof down the center of the bracket for a portion of its length. A pair of stabilizing tabs 34 extend transversely to the flange brackets from one end thereof. Each stabilizing tab has a hole 35 therein for receiving hooks 36 at the end of tension springs 16 and 17.

FIG. 2 is a perspective view of the floor joist square 10 shown with flange brackets 14 and 15 inserted in slots 31*c* with springs 16,17 (only one shown) inserted in holes 35 of stabilizing tabs 34. The stabilizing tabs 34 function to hold the flange brackets 14,15 perpendicular to the template plate 12 while inserted within slots 31.

Once the flange brackets are inserted into a particular pair of slots, the floor joist square 10 can be used to mark all of the floor joist lumber of a particular height. When it is required that floor joist lumber of a different height be marked for cutting, the flange brackets 14,15 are easily removed from the slots and repositioned in a different pair of slots, as illustrated in FIG. 3.

Figure 4:
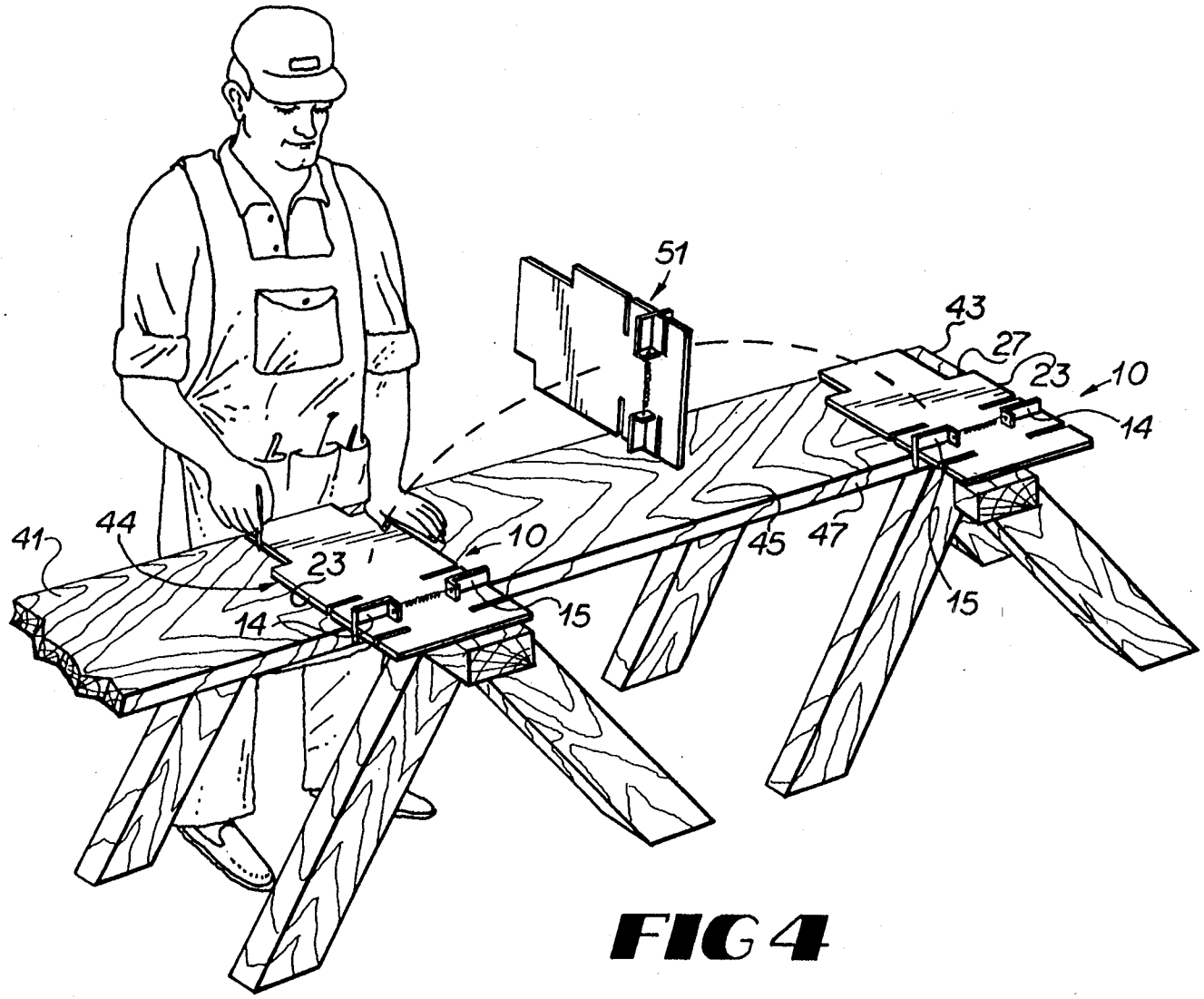
FIG. 4 is a perspective view of a carpenter using the floor joist square to mark a length of floor joist lumber.

FIG. 4 illustrates a carpenter using the floor joist square 10 to mark a length of floor joist lumber 41. A single carpenter can use the floor joist square to mark a first end of the lumber 43 and then mark the other end 44 of the floor joist board 45 to be cut. As shown in FIG. 4, the flange brackets 14,15 are positioned in slots 31*b* (the middle set of slots shown in FIGS. 1 through 3), which correspond with a floor joist board having a height of 10 inches. The carpenter first uses the floor joist square at end 43 of the floor joist lumber 41 with notch 27 aligned along the lower corner of the lumber and with the flange brackets 14,15 abutting the top longitudinal edge 47 of the floor joist board 45. With the floor joist square 10 in position, the carpenter marks on the floor joist lumber 41 along the side edge 23 of the floor joistsquare and along the contours of notch 27. Then the carpenter cuts the floor joist board 45 along this marked line.

Next, the carpenter flips the floor joist square 10 as shown at 51 so that the backside of the floor joist square 10 lies against the lumber 41. The carpenter then measures off the length of the floor joist board to be cut and positions the side edge 23 of the floor joist square 10 at this length and again traces a cut line along the side edge 23 of the floor joist square 41. The carpenter then cuts along this cut line to produce a floor joist board 45 with a set notches in the lower corners thereof corresponding to a 2×4 inch board timber and with the notches spaced an accurate distance from the top longitudinal edge 47 of the floor joist board.

Thus, it can be seen that a single operator can use the floor joist square 10 to mark and cut a length of floor joist lumber in an efficient and quick manner with the notches properly spaced from the top edge of the board.

After the floor joist board is cut, it can be mounted transversely between the perimeter sill and a center beam of the center sill support framework of a building with the notched corner of the floor joist board mating with the bond timber of the center beam or perimeter sill. The upper side of the notched segment rests on the bond timber and is supported thereby. So arranged, the top longitudinal edges of the floor joist boards lies flush with the top longitudinal edges of the center beam and perimeter sill so that a center sill support framework is created having an upper surface lying substantially in a common plane so that a second board, such as plywood or subflooring, can be fastened thereto in a level manner.

It should be noted that the floor joist square of the present invention can be utilized to mark other boards requiring a notched portion spaced a precise distance from an edge of the board, such as ceiling joists.

The features and principles of the present invention have been illustrated in the foregoing description of a preferred embodiment thereof. It will be apparent to those skilled in the art that numerous changes or modifications may be made thereto without departure from the spirit and scope of the invention.

What is claimed is:

1. A template for tracing a cut-line along a board having a top longitudinal edge, the cut-line having a segment spaced from the top longitudinal edge a first predetermined distance, comprising:

a plate including a side edge in the shape of the cut-line to be marked for tracing the cut-line on the board, the side edge including a segment corresponding to the segment of the cut-line, and means on the plate for aligning the side edge against the board comprising a pair of flange pieces adjustably secured to the plate perpendicular thereto and spaced from the segment of the side edge for engaging the top longitudinal edge of the board so that the segment of the side edge is spaced from the top longitudinal edge of the board the first predetermined distance, and wherein the plate includes a set of pairs of aligned slots, with each pair of slots including a slot extending inwardly from opposite edges of the plate and adapted to receive therein one of said pair of flange pieces, each slot being spaced from the segment of the side edge a second predetermined distance as measured in a direction perpendicular to the slots, whereby upon alignment of the side edge of the plate against the board, the board can be traced with the cut-line and cut therealong to produce a cut side edge of the board wherein the top longitudinal edge of the board is spaced from the segment of the cut-line the first predetermined distance.

2. A template square for tracing a cut-line along a floor joist board cutting therealong to produce a cut side edge at the end of a floor joist board segment adapted to a mate with a support beam transverse to the floor joist board, the floor joist board and the support beam having top edges to which plywood is to be mounted to create a subflooring, the cut-line including a notched portion with a first segment parallel to the top edge and a second segment perpendicular to the top edge, the support beam having a bond timber along its lower edge and spaced from its top edge a predetermined distance, the bond timber having dimensions substantially equivalent to the notched portion of the cut-line, the template square comprising:

a template plate including a side edge in the shape of the cut-line to be marked for tracing on the floor joist board, and a flange piece mounted perpendicularly to the template plate parallel with the first segment of the notched portion and spaced therefrom the predetermined distance for engaging the top edge of the floor joist board and aligning the side edge of the template plate against the floor joist board with the first segment of the notched portion spaced the predetermined distance from the top edge of the board, and wherein the flange piece extends forwardly and rearwardly of the template plate to form a flange on the front side and the back side of the template plate, whereby a cut-line can be traced along the side edge with the back side of the plate against the board, and a transposed mirror-image cut-line can be traced along the side edge with the front side of the plate against the board;

a second side edge opposed to the first side edge, a second flange piece mounted perpendicularly to the template plate, and wherein the template square has a second series of slots for securably receiving the second flange piece, the second side edge being in the shape of a second cut-line with the second cut-line having a notched portion with a first segment parallel to the top edge of the floor joist board and a second segment perpendicular to the top edge, the second segment of the second cut-line having a dimension greater than the dimension of the second segment of the first cut-line, whereby, upon alignment of the side edge against the board, the board can be traced with the cut-line and cut therealong to produce a cut side edge on the floor joist board having a first segment corresponding to the first segment of the cut-line, and the cut side edge of the floor joist board can be mounted to the support beam with the first segment of the cut side edge supported by the bond timber and the top edges of the floor joist board and support beam lying substantially in a common plane to create a level support structure for the sub-flooring.

3. A template for tracing a cut-line along a board having a top longitudinal edge, the cut-line having a segment spaced from the top longitudinal edge a predetermined distance, comprising:

a plate comprising a side edge in the shape of the cut-line to be marked for tracing the cut-line on the board, the side edge including a segment corresponding to the segment of the cut-line, a second edge in the shape of a second cut-line to be traced on the board, the second cut-line having a segment spaced from the top longitudinal edge of the board a second predetermined distance, the second edge including a segment corresponding to the segment of the second cut-line, means on the plate for aligning the side edge against the board and with respect to the top longitudinal edge of the board so that the segment of the side edge is spaced from the top longitudinal edge of the board the predetermined distance, means for aligning the second plate edge against the board with respect to the top longitudinal edge of the board with the segment of the second plate edge spaced from the top longitudinal edge of the board at the second predetermined distance, wherein the means for aligning the first plate edge and the means for aligning the second plate edge each include a flange piece and a set of slots formed in the plate for receiving the flange piece, the slots of each set of slots being aligned with each other, and further comprising biasing means for urging the flange pieces into their slots, whereby upon alignment of the side edge of the plate against the board, the board can be traced with the cut-line and cut therealong, to produce a cut side edge of the board wherein the top longitudinal edge of the board is spaced from the segment of the cut-line the predetermined distance and whereby, upon alignment of the second plate edge on the board, the board can be traced with the second cut-line and cut therealong, to produce a cut side edge in the board wherein the top longitudinal edge of the board is spaced the second predetermined distance from the segment of the second cut-line.

* * * * *